US009810245B2

(12) United States Patent
Jaccoby et al.

(10) Patent No.: US 9,810,245 B2
(45) Date of Patent: Nov. 7, 2017

(54) SPRING RETURN ACTUATOR

(71) Applicant: Habonim Industrial Valves & Actuators Ltd., Galil Elion (IL)

(72) Inventors: Gaby Jaccoby, Carmiel (IL); Ido Navon, Lower Galilee (IL); Yoel Hadar, Kiryat Shmona (IL); Efraim Maayan, Galil Elion (IL)

(73) Assignee: Habonim Industrial Valves & Actuators Ltd., Galil Elion (IL)

( * ) Notice: Subject to any disclaimer, the term of this patent is extended or adjusted under 35 U.S.C. 154(b) by 394 days.

(21) Appl. No.: 13/831,851

(22) Filed: Mar. 15, 2013

(65) Prior Publication Data

US 2014/0260953 A1 Sep. 18, 2014

(51) Int. Cl.

| | |
|---|---|
| ***F15B 15/14*** | (2006.01) |
| ***F15B 15/02*** | (2006.01) |
| *F15B 15/06* | (2006.01) |
| *F15B 20/00* | (2006.01) |

(52) U.S. Cl.

CPC ..... *F15B 15/02* (2013.01); *F15B 15/1409* (2013.01); *F15B 15/1476* (2013.01); *F15B 15/065* (2013.01); *F15B 20/004* (2013.01); *F15B 2211/7052* (2013.01); *F15B 2211/7055* (2013.01); *F15B 2211/863* (2013.01); *F15B 2211/8752* (2013.01)

(58) Field of Classification Search

CPC F15B 15/1409; F15B 15/1476; F15B 15/066; F15B 15/065

See application file for complete search history.

(56) References Cited

U.S. PATENT DOCUMENTS

| | | | | |
|---|---|---|---|---|
| 3,752,161 A * | 8/1973 | Bent | ..... | 606/184 |
| 4,167,897 A * | 9/1979 | Bunyard | ..... | 92/69 R |
| 5,492,050 A | 2/1996 | Holtgraver | | |
| 5,950,427 A * | 9/1999 | Demerjian et al. | ..... | 60/404 |
| 6,314,862 B1 * | 11/2001 | Retterer | ..... | 92/62 |

(Continued)

FOREIGN PATENT DOCUMENTS

| | | | |
|---|---|---|---|
| DE | 3741261 | 7/1988 | |
| DE | 3741261 A1 * | 7/1988 | ..... F15B 15/065 |

(Continued)

OTHER PUBLICATIONS

DE 3925887 GT—Machine Translation from Google (GT), Double acting pneumatic drive unit, Pub date—Feb. 7, 1991.*

(Continued)

*Primary Examiner* — F. Daniel Lopez
(74) *Attorney, Agent, or Firm* — A. C. Entis-IP Ltd.

(57) ABSTRACT

Aspects of embodiments of the invention relate to a spring-return actuator comprising a first piston movable between a first and a second position by pressurized fluid to move a load; a safety system comprising a second piston movable by the pressurized fluid to arm the safety system and which returns the first piston from the second position to the first position when de-energizing the 3/2 pilot valve or when the pressure of the pressurized fluid drops below a safety pressure threshold; and a differential fluid channel for providing the pressurized fluid and configured so that the first piston while working to move the load remains substantially disengaged from the safety system being armed.

11 Claims, 8 Drawing Sheets

(56) References Cited

U.S. PATENT DOCUMENTS

| | | | | |
|---|---|---|---|---|
| 6,371,439 | B1 * | 4/2002 | Trevisan | 251/58 |
| 6,708,489 | B2 * | 3/2004 | Massey et al. | 60/406 |
| 7,698,991 | B2 * | 4/2010 | Sato et al. | 92/130 C |
| 7,946,215 | B2 | 5/2011 | Nemenoff | |
| 2003/0024239 | A1 | 2/2003 | Massey et al. | |
| 2010/0187454 | A1 * | 7/2010 | Arnold | F16K 31/1225 251/89 |
| 2012/0037238 | A1 * | 2/2012 | Studer | 137/14 |

FOREIGN PATENT DOCUMENTS

| | | | | |
|---|---|---|---|---|
| DE | 3925887 | | 2/1991 | |
| DE | 3925887 | A1 * | 2/1991 | F15B 15/06 |
| DE | 102006028878 | | 12/2007 | |
| EP | 0077596 | | 4/1983 | |
| EP | 236748 | | 9/1987 | |
| GB | 2181519 | | 4/1987 | |
| GB | 2199115 | | 6/1988 | |
| JP | H07269511 | | 9/1995 | |
| JP | 3034246 | | 4/2000 | |
| JP | 2007285404 | | 11/2007 | |
| WO | 2012073172 | | 6/2012 | |

OTHER PUBLICATIONS

International Search Report dated Mar. 15, 2012 for PCT Application PCT/IB2011/055319, international filed date Nov. 28, 2011.

International Search Report dated Jul. 1, 2014 for corresponding PCT Application PCT/IL2014/050168, international filing date Feb. 17, 2014.

Chinese Office Action dated Jun. 6, 2016 for Chinese Application No. 2014800279658, filed Nov. 13, 2015.

International Search Report dated Jun. 13, 2016 for PCT Application PCT/IB2015/057737, international filing dated Oct. 9, 2015.

* cited by examiner

SPRING RETURN ACTUATOR

TECHNICAL FIELD

Embodiments relate to spring-return actuators.

BACKGROUND

Various types of spring-return actuators are known in the art. They generally comprise a piston seated in a load chamber and a set of springs in a safety chamber. A pilot valve introduces a fluid, such as a gas or liquid, under pressure into the load chamber to generate a force that moves the piston in the load chamber, and to simultaneously compress the springs in the safety chamber. Under normal operation a pilot valve releases fluid from the load chamber so that the return spring is released and generates force that returns the load piston back to its safe position. The return spring automatically releases to return the load piston back to its safe position in the event of a loss of fluid operating pressure. The initial, safe position of the actuator piston is generally a position for which a load coupled to the piston is considered to be in a corresponding initial, "benign", position of the load. A coupling element, such as a piston rod, or a rack of a rack and pinion transmission, couples motion of the piston in the load chamber to a load to apply force to and thereby control motion of the load.

SUMMARY

Aspects of embodiments relate to a spring-return actuator for moving a load to which the spring-return actuator is coupled and that employs a safety system for returning a load piston from a working position to an initial safe position after a power stroke applied by the load piston for moving the load. A working position is defined as a position in which the load pistons are not in the initial safe position.

The safety system comprises a return spring and a safety piston which are housed in a first piston cylinder chamber, hereinafter a safety chamber, sealed from another piston cylinder chamber, hereinafter a load chamber, in which the load piston is housed. The return spring returns the load piston from its working position to its initial safe position by pushing the safety piston from an armed to an unarmed position when pressure in the safety chamber drops below a safety pressure threshold.

The spring-return actuator comprises a differential fluid channel configured so that pressurized fluid is introduced into the safety chamber at a higher flow rate than into the load chamber so that the load and safety pistons are disengaged during a power stroke of the load piston. As a result, during the power stroke, as the load piston moves from an initial safe position to a working position to move a load, force provided by the power piston to move the load is independent of force required to compress and arm the return spring.

An actuator in which the load piston remains disengaged from the return spring during the power stroke may hereinafter be referred to as a split-action actuator (SPA).

The differential fluid channel may be comprised in the housing of the spring-return actuator and/or may have an inlet that is shared by the safety chamber and the load chamber.

Further aspects of embodiments may relate to providing a spring-return actuator, hereinafter a "double SPA (D-SPA)" actuator that comprises at least one set of paired SPA actuators. A D-SPA actuator in accordance with an embodiment of the invention comprises a commonly shared load chamber housing a pair of load pistons, a first and a second load piston, for controlling motion of a load. The D-SPA actuator according to embodiments further comprises two safety chambers each respectively housing a first and second safety piston and configured to arm a corresponding safety system. The first load and safety piston are in tandem configuration and are mirrored with respect to the second load and safety piston, which are also in tandem configuration.

When de-energizing the pilot valve or when fluid operating pressure decreases below a safety pressure threshold, the safety pistons move from an armed to an unarmed position, and return the two load pistons from a working to an initial safe position.

As a result, for a given force applied to the load, the load piston or pistons of the above-mentioned spring-return actuators operate at a higher efficiency than load pistons in conventional spring-return actuators.

In some embodiments, the pressurized fluid is gas. Optionally, the pressurized fluid is a liquid.

In some embodiments, the load chamber houses a transmission such as a rack and pinion transmission for transmitting motion of the load pistons to move the load. In some other embodiments the load chamber houses a Scotch-Yoke transmission.

In the discussion, unless otherwise stated, adverbs such as "substantially" and "about" modifying a condition or relationship characteristic of a feature or features of an embodiment of the invention, are understood to mean that the condition or characteristic is defined to within tolerances that are acceptable for operation of the embodiment for an application for which it is intended.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF FIGURES

Non-limiting examples of embodiments are described below with reference to figures attached hereto that are listed following this paragraph. Identical structures, elements or parts that appear in more than one figure are generally labeled with a same numeral in all the figures in which they appear. Dimensions of components and features shown in the figures are chosen for convenience and clarity of presentation and are not necessarily shown to scale.

DETAILED DESCRIPTION

Figure 1:
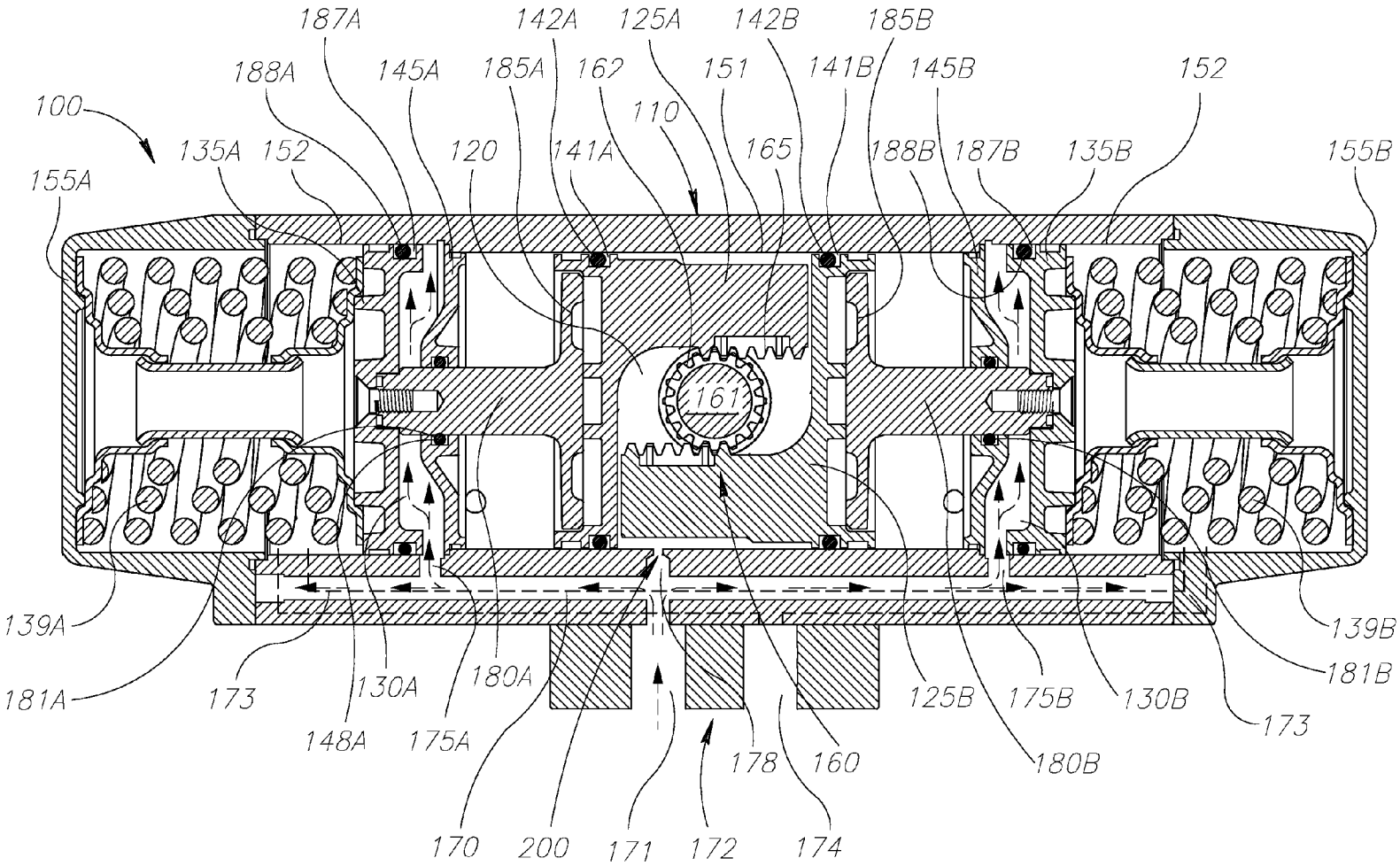
FIG. 1 is a schematic cross-sectional view of a D-SPA actuator comprising a differential fluid channel, in accordance with an embodiment of the invention.

Reference is now made to FIG. 1, which schematically illustrates a cross-sectional side view of a D-SPA actuator 100, in accordance with an embodiment.

D-SPA actuator 100 comprises a housing 110 formed having a load chamber 120 between a first safety chamber 130A and a second safety chamber 130B. Load chamber 120 is thus in tandem to both first safety chamber 130A and second safety chamber 130B. A first septum wall 145A separates first safety chamber 130A from load chamber 120, and a second septum wall 145B separates second safety chamber 130B from load chamber 120.

Load chamber 120 houses a pair of load pistons, a first load piston 125A and a second load piston 125B that are slidably received by load chamber 120 and configured to be substantially sealed to an inner wall 151 thereof. First and second load pistons 125A and 125B may for example each have grooves 141A and 141B, formed in rims for seating a first sealing element 142A and a second sealing element 142B, respectively, such as, for example, an o-ring, or piston ring.

Load pistons 125A and 125B may be attached to a transmission 160 that couples their motion to a load (not shown) that D-SPA actuator 100 controls. Transmission 160 may for example be a rack and pinion transmission that rotates a drive shaft 161 that extends out from housing 110 through a clearance hole (not shown) formed in housing 110. Drive shaft 161 may be substantially sealed to the clearance hole against fluid leakage, e.g., by an o-ring, which may be seated in a groove (not shown) formed in housing 110 of the clearance hole. In the rack and pinion transmission, each load piston 125A and 125B is coupled to a rack gear 165 that meshes with a pinion gear 162 formed on drive shaft 161. Motion of the load pistons in load chamber 120 generates torque that turns drive shaft 161. Drive shaft 161 may for example be a shaft that is rotated by D-SPA actuator 100 to open and close a valve.

Safety chambers 130A and 130B respectively house safety pistons 135A and 135B, and return springs 139A and 139B. Return springs 139A and 139B seat in respective safety chambers 130A and 130B between safety pistons 135A and 135B and face end covers 155A and 155B of the corresponding safety chamber. Plungers 180A and 180B are connected to safety pistons 135A and 135B respectively and seat on load pistons 125A and 125B when return springs 139A and 139B are fully extended in the safety chambers and the load pistons are in their respective safe positions. As discussed below, return springs 139A and 139B operate to return a corresponding load piston 125A and 125B from its working position to its respective initial safe position should the pressure in load chamber 120 decrease below a pressure threshold.

Safety pistons 135A and 135B may be configured to be substantially sealed against inner wall 152 of the corresponding safety chamber by employing a sealing arrangement. Sealing arrangement may for instance comprise first and second grooves 187A and 187B respectively formed in rims of safety pistons 135A and 135B and sealing elements 188A and 188B e.g., o-rings or piston rings, that seat in the grooves.

A pressurized operating fluid is introduced into load chamber 120 and safety chambers 130A and 130B via an optionally same differential fluid channel 170. Pressure of the fluid drives load pistons 125A and 125B from their respective safe positions to respective working positions to rotate drive shaft 161, and drives safety pistons to compress return springs 139A and 139B. The fluid flow channel and volumes of load chamber 120 and safety chambers 130A and 130B are configured so that as the safety pistons compress return springs 139A and 139B, plungers 180A and 180B move away from load pistons 125A and 125B so that the load pistons can move to rotate drive shaft 161.

In an embodiment of the invention, differential fluid channel 170 prioritizes flow of pressurized fluid into safety chambers 130A and 130B over flow of pressurized fluid into load chamber 120 so that safety pistons 135A and 135B start to compress return springs 139A and 139B before load pistons 125A and 125B start moving into a working position. Therefore, plungers 180A and 180B disengage from load pistons 125A and 125B before the load pistons start working against a load. Plungers 180A and 180B remain disengaged from load pistons 125A and 125B at least until return springs 139A and 139B are in a substantially fully compressed or armed position.

The inside diameter of an inner sidewall 152 of safety chambers 130A and 130B is larger than the inside diameter of an inner sidewall 151 of the load chamber 120, resulting in higher overall actuator efficiency.

Differential fluid channel 170, which may at least partially be formed in housing 110, is in fluid communication with load chamber 120, via a fluid inlet 178 and in fluid communication with safety chambers 130A and 130B via fluid inlets 175A and 175B, respectively. In an embodiment of the invention, operating fluid under pressure is introduced into differential fluid channel 170 via an inlet port 171, optionally formed in an inlet adapter 172. The pressurized operating fluid introduced into differential fluid channel 170 flows into load chamber 120 via fluid inlet 178 and into safety chambers 130A and 130B via fluid inlets 175A and 175B. The pressurized operating fluid entering load chamber 120 forces load pistons 125A and 125B away from their initial safe positions toward their respective working positions so that they rotate drive shaft 161. The pressurized operating fluid entering safety chambers 130A and 130B forces safety pistons 135A and 135B to compress return springs 139A and 139B.

Fluid inlets 178, 175A and 175B are configured so that the pressurized operating fluid flows more slowly into load chamber 120 than into safety chambers 130A and 130B. Safety pistons 135A and 135B therefore move away from load pistons 125A and 125B respectively and displace plungers 180A and 180B, which extend from safety pistons 135A and 135B respectively and contact load pistons 125A and 125B in the safety positions, away from the load pistons. As a result, during operation of load pistons 125A and 125B to turn drive shaft 161, plungers 180A and 180B compress return springs 139A and 139B without generating force on the load pistons via plungers 180A and 180B.

An exhaust channel 173 schematically indicated by dashed lines and optionally formed in housing 110 is in fluid communication with a volume of load chamber 120 on the sides of load pistons 125A and 125B that face towards fluid inlet 178. Exhaust channel 173 is also in fluid cooperation with safety chambers 130A and 130B on sides of safety pistons 135A and 135B, which face end covers 155A and 155B respectively. Exhaust channel 173 and a vent 174 vent fluid from chambers 120, 130A and 130B that might oppose motion of the pistons.

In FIG. 1 safety pistons 135A and 135B are positioned in a "unarmed" position for which they are adjacent to, and optionally contact respective septum walls 145A and 145B, and return springs 139A and 139B are in a relatively non-compressed state in which they are extended to a maximum in respective safety chambers 130A and 130B.

Plungers 180A and 180B are each coupled to each one of safety pistons 135A and 135B on a side of safety pistons 135A and 135B opposite to a side facing the return springs 139A and 139B, respectively. Plungers 180A and 180B extend into load chamber 120 through the corresponding clearance holes (not shown) respectively formed in septum walls 145A and 145B of housing 110. Plungers 180A and 180B are substantially sealed to the wall of the clearance hole by sealing elements like 181A and 181B, e.g., an o-ring, seated in a groove 148A and 148B of septum walls 145A and 145B, respectively, to substantially seal and prevent leakage of fluid between safety chambers 130A and 130B and load chamber 120. Plungers 180A and 180B are each respectively connected to a touch plate 185A and 185B that contact corresponding load pistons 125A and 125B when, as schematically shown in FIG. 1, load pistons 125A and 125B are in their initial safe position and safety pistons 135A and 135B are in an unarmed position.

Figure 2B:
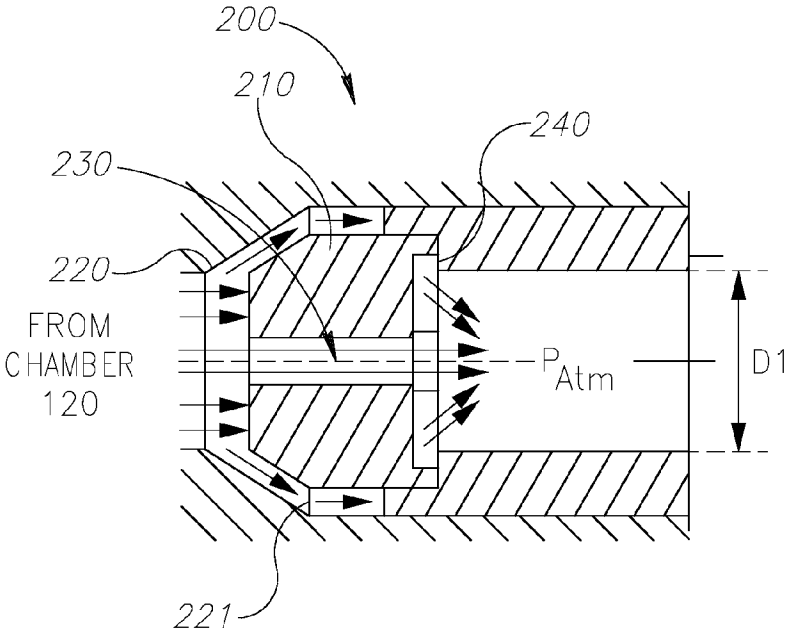
FIGS. 2A and 2B show schematic enlarged cross-sectional views of a flow-rate reducer comprised in the differential fluid channel, in accordance with an embodiment of the invention.
Figure 2A:
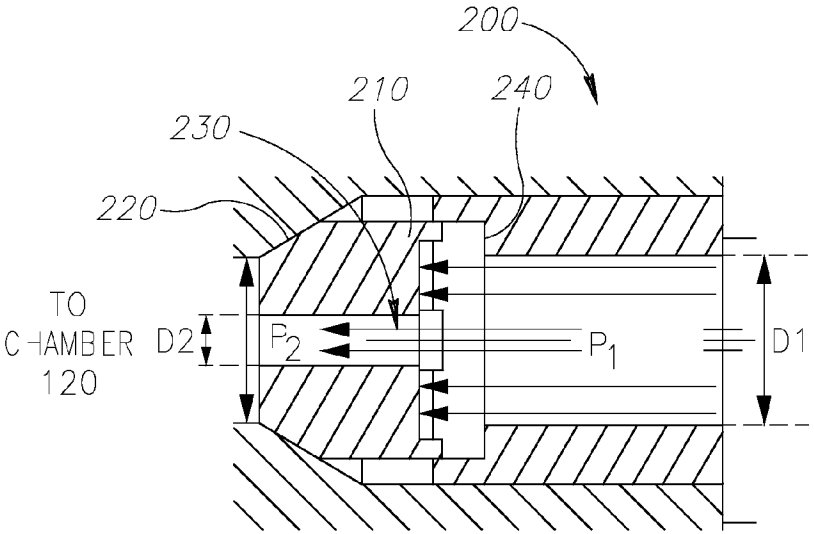

Additionally referring now to FIGS. 2A and 2B, fluid inlet 178 may in some embodiments comprise a flow-rate reducer arrangement 200 causing the flow rate of the pressurized fluid flowing into load chamber 120 to be comparably lower than the flow rate of the pressurized fluid to flow into safety chambers 130A and 130B.

Flow-rate reducer arrangement 200 may for example be embodied by a narrowing of the cross-sectional area, e.g., by a ratio of 1 to 5 or less, of fluid inlet 178 in the direction of the flow of the pressurized fluid into load chamber 120. For example, a sudden or abrupt flow reduction in the diameter of fluid inlet 178 may cause head loss to result in a flow rate in fluid inlet 178 that is comparably lower than the flow rate of the pressurized fluid flowing in fluid inlets 175A and 175B.

FIGS. 2A and 2B schematically illustrate a flow-rate reducer arrangement 200 embodied by a one-way contraction valve that causes sudden contraction of the section of differential fluid channel 170 for pressurized fluid flowing in a first direction, schematically shown in FIG. 2A, into load chamber 120, through one-way contraction valve but not for fluid flowing in a second, opposite direction, schematically shown in FIG. 2B, out of load chamber 120. One-way contraction valve may for example be embodied by a self- or medium-operated valve that comprises a valve member 210 seated in fluid inlet 178 and whose position is responsive to pressure changes of the fluid in differential fluid channel 170 such that inflow and outflow of the pressurized fluid is regulated through pressure change of regulated medium itself.

As is schematically shown in FIG. 2A, inflow of pressurized fluid towards load chamber 120 causes valve member 210 to substantially seal against an inner wall 220 of one-way contraction valve, thereby confining flow of the pressurized fluid through a sudden contraction of valve member 210 in which the diameter decreases from D1 to D2. The sudden contraction causes fluid pressure to drop from P1 in the non-contracted side to P2 in the contracted side, resulting in a reduction in the flow rate of the pressurized fluid into load chamber 120 relative to the flow rate into safety chambers 130A and 130B.

On the other hand, as is schematically shown in FIG. 2B, outflow of pressurized fluid from load chamber 120 causes valve member 210 to move away from inner wall 220 until valve member 210 engages with a shoulder 240 of fluid inlet 178, creating a fluid passageway 221 around valve member 210 so that operating fluid may flow out of load chamber 120 and safety chambers 135A and 135B at about the same rate.

Further reference is now made to FIGS. 3A-3D, which schematically shows D-SPA actuator 100 at different stages after it is controlled to move a load (not shown) to which it is attached, in accordance with an embodiment.

Figure 3A:
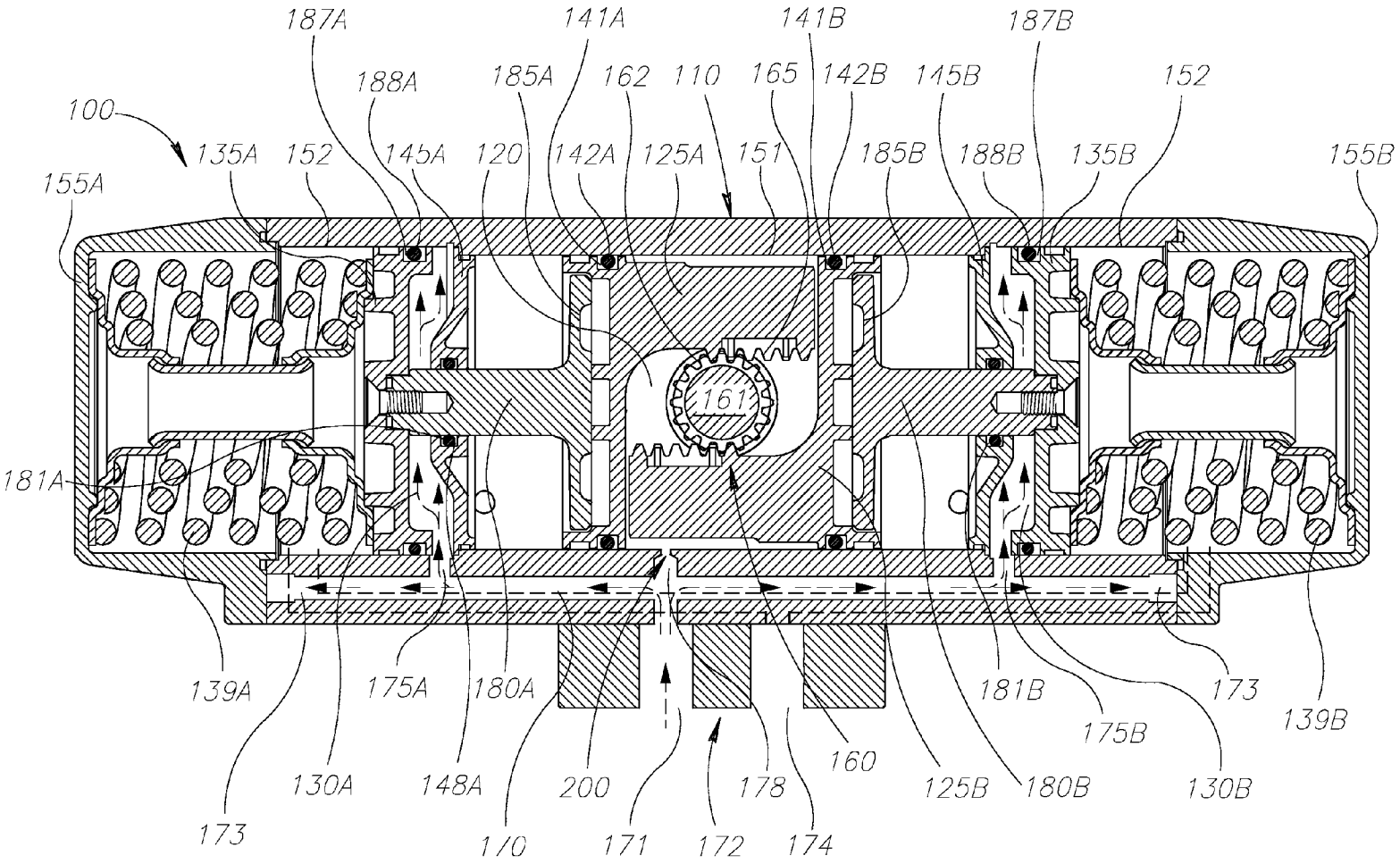
FIGS. 3A to 3D show schematic cross-sectional views of a D-SPA actuator showing its operation, in accordance with an embodiment of the invention.
Figure 3B:
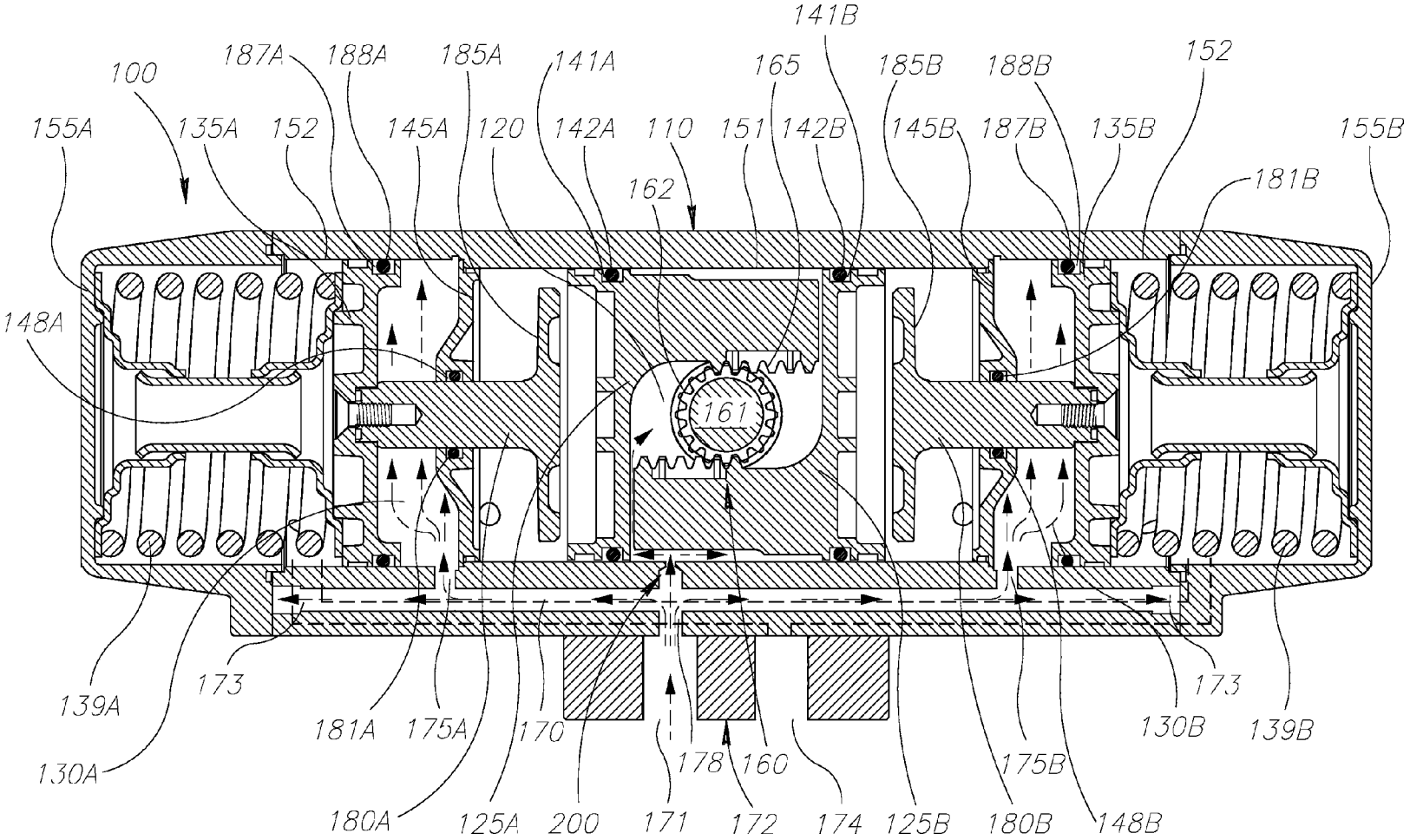
Figure 3C:
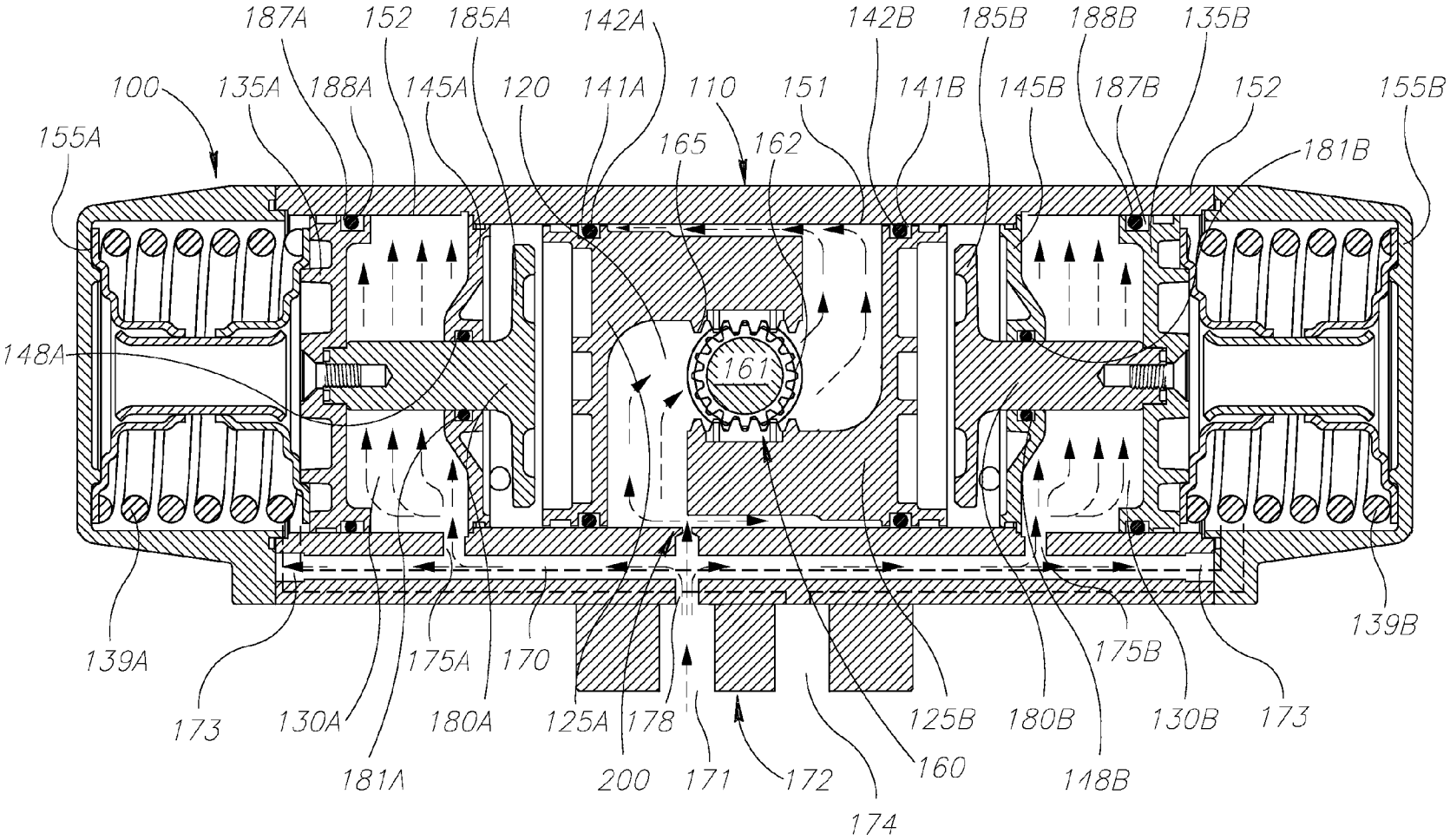
Figure 3D:
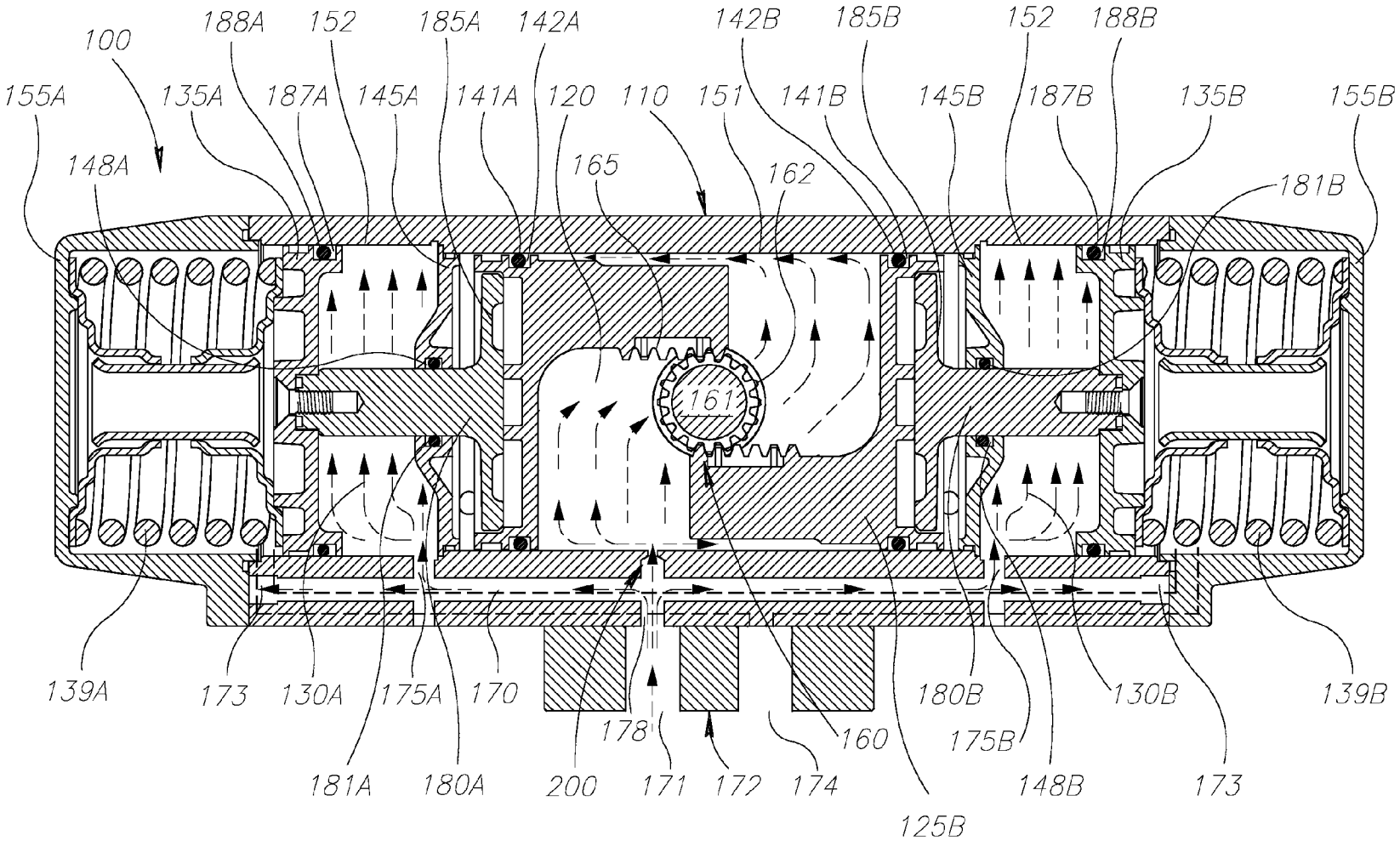

As schematically shown in FIG. 3A, the different flow rates of pressurized fluid into load chamber 120 and safety chambers 130A and 130B results in that safety chambers 130A and 130B are filled up more rapidly with operating fluid than load chamber 120. Safety pistons 135A and 135B disengage therefore from septum walls 145A and 145B and compress return springs 139A and 139B before load pistons 125A and 125B begin to move away from their initial safe position. The pressure difference between the operating fluid in load chamber 120 and the operating fluid in safety chambers 130A and 130B may be large enough so that load pistons 125A and 125B remain substantially unaffected by the force that return springs 139A and 139B respectively apply onto safety pistons 135A and 135B, as is schematically illustrated in FIG. 3C, until return springs 139A and 139B are in their armed position, which is schematically shown in FIG. 3D. In other words, until return springs 139 are in their armed position (FIG. 3D), neither load piston 125A nor load piston 125B works against the force applied by return spring 139A and 139B onto safety piston 135A and 135B, respectively (FIGS. 3A-3C).

In some embodiments, load pistons 125A and 125B move from their initial safe position to a working position not before safety pistons 135A and 135B and return springs 139A and 139B are in an armed position. In some other embodiments, load pistons 125A and 125B may begin to move from their initial safe position towards a working position while return springs 139A and 139B are being compressed into their armed position.

The introduction of pressurized fluid into safety chambers 130A and 130B forces safety pistons 135A and 135B away from their unarmed positions, thereby compressing return springs 139A and 139B and extracting plungers 180A and 180B from load chamber 120, respectively. Upon initiating motion of safety pistons 135A and 135B, corresponding touch plates 185A and 185B move away from load pistons 125A and 125B and remove any force generated by return springs 139A and 139B that touch plates 185A and 185B apply to load pistons 125A and 125B, respectively.

After being freed from force generated by return springs 139A and 139B, the increase in pressure by introducing pressurized fluid into load chamber 120 via differential fluid channel 170 forces load pistons 125A and 125B away from their initial safe position and slide toward the working position. Pressurized operating fluid is continuously flowed into load chamber 120 and safety chambers 130A and 130B via commonly shared flow inlet port 171 at rates sufficient to prevent touch plates 185A and 185B from applying force to load pistons 125A and 125B, until each one of safety pistons 135A and 135B reaches a final armed position and return springs 139A and 139B are in an armed, substantially fully compressed state. As is schematically illustrated in FIG. 3D, load pistons 125A and 125B may shortly thereafter reach their working positions, at which load pistons 125A and 125B optionally contact again touch plates 185A and 185B, respectively.

As long as pressure in the operating fluid in safety chambers 130A and 130B remains above a "safety" pressure threshold for which pressure on safety pistons 135A and 135B is sufficient to generate a force that maintains return springs 139A and 139B substantially fully compressed, they remain in the armed position. If the pressure drops below the safety pressure, return springs 139A and 139B respectively force load pistons 125A and 125B and safety pistons 135A and 135B back into their respectively initial safe and unarmed positions, schematically shown by way of example in FIG. 1.

It is noted that, in accordance with an embodiment, a load piston of a single and split-action actuator operates at a greater efficiency than a load piston in a conventional fluid actuator. The equations outlined herein below refer to a single and split-action actuator that comprises one load piston and one return spring in tandem configuration. However, the advantageous principles demonstrated by these equations are, with the relevant adjustments, analogously applicable to D-SPA actuator 100 exemplified herein in conjunction with FIGS. 1 and 3A-3D.

By way of a simplified example, assume that a conventional fluid actuator comprising a load piston that operates to simultaneously move a load and arm a return spring is required to apply a force "$F_L$" to move a load between initial safe and working positions. Assume further that it is desired that the return spring return the load to its initial safe position if pressure in a fluid that operates the actuator drops below a safety pressure "$P_S$". Let the return spring, when substantially fully compressed to its armed position, exert a return force "$F_R$" to return the load to its initial safe position. Then, upon operating fluid pressure dropping to below $P_S$, at least initially, $F_R$ satisfies a relation $F_R \geq (F_L + AP_S)$, where A is a cross section of the load piston on which the pressurized operating fluid operates. To compress the return spring to its armed position, and also move the load, the load piston must be able to provide an operating force "$F_O$" that satisfies a relation $F_O \geq (2F_L + AP_S)$.

On the other hand, in accordance with an embodiment, a load piston in a D-SPA actuator comprising a differential fluid channel for providing the pressurized fluid may not operate to compress a return spring and can therefore function satisfactorily by providing an operating force "$F^*_O$" for which $F^*_O \geq F_L$. The operating force provided by the load piston comprised in the D-SPA actuator in accordance with an embodiment is constrained by a significantly lower minimum threshold than a load piston in a conventional fluid operated actuator.

For a same force to be provided to a load by a fluid operated actuator, the lower minimum operating force threshold generally enables a D-SPA actuator in accordance with an embodiment to operate at lower operating pressures and/or to have a smaller cross section load piston than a conventional fluid operated actuator. For example, for a same operating fluid pressure, a D-SPA actuator in accordance with an embodiment having a same cross section as a conventional spring return actuator provides at least twice a force as the conventional actuator, that is $F^*_O \geq 2F_O$. If the force is required to generate a torque, for example to rotate a shaft of a valve to open and/or close the valve, for a same torque arm, the D-SPA actuator in accordance with an embodiment of the invention, provides at least twice the torque as the conventional spring return actuator.

Practice of aspects of embodiments exemplified herein with respect to FIGS. 1 and 3A-3D may of course not be limited to comprising two sets of a load and a safety piston sharing a load chamber. Correspondingly, practice of aspects of embodiments described herein may relate to D-SPA actuators that comprise more than two such sets.

Figure 4A:
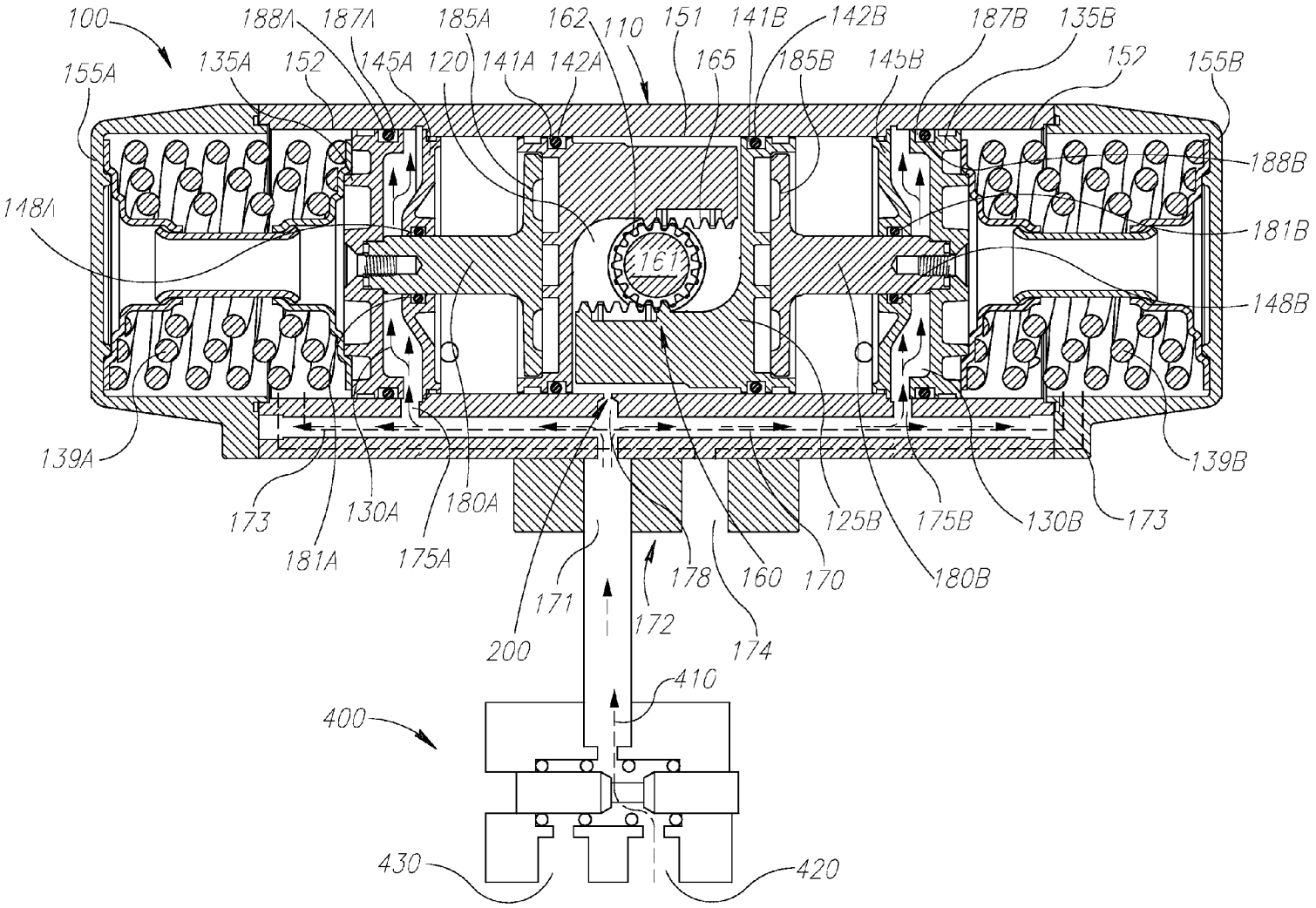
FIGS. 4A to 4B show schematic cross-sectional views of a D-SPA actuator showing its operation in conjunction with a 3/2 pilot valve, in accordance with an embodiment of the invention.
Figure 4B:
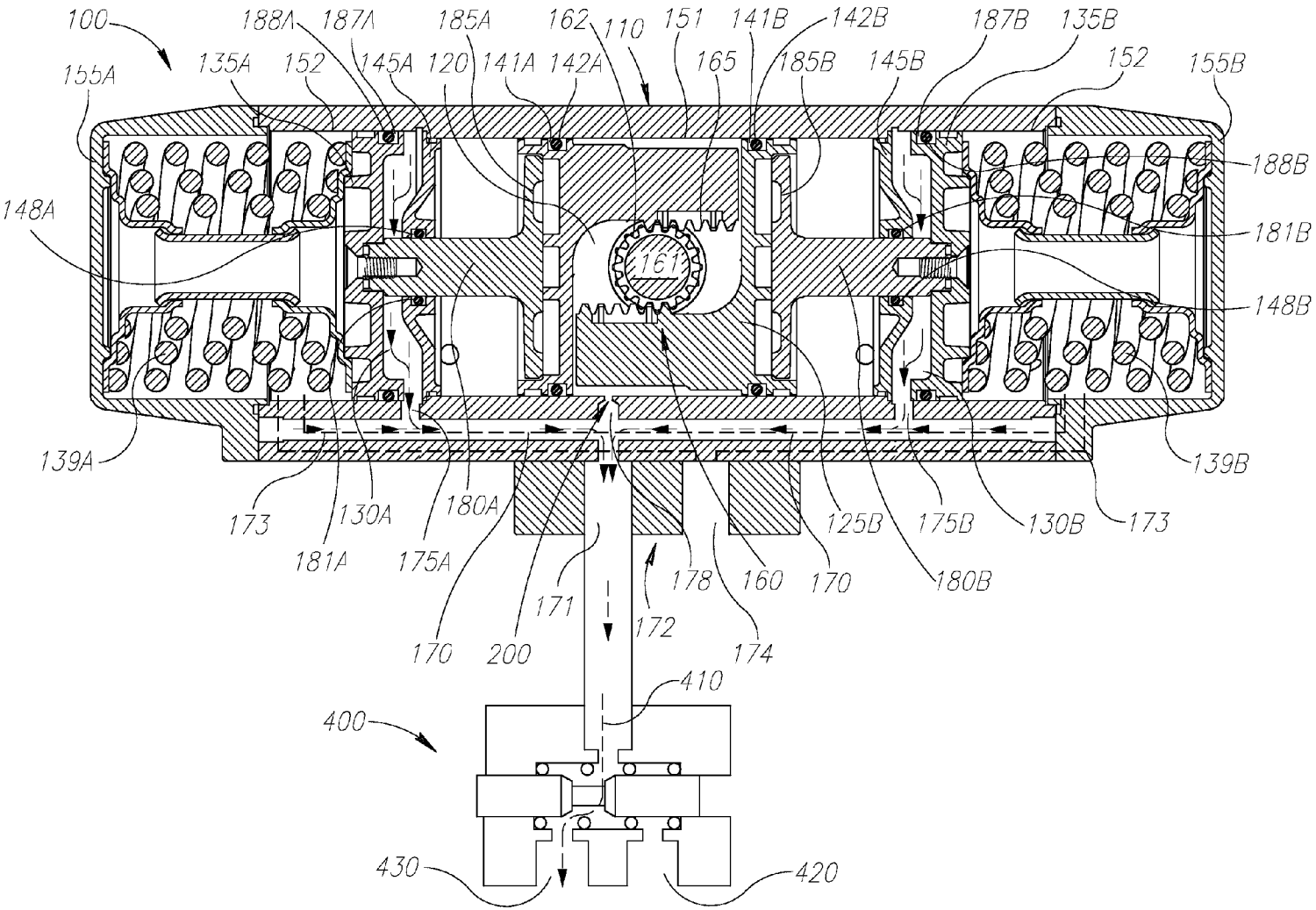

Further reference is now made to FIGS. 4A and 4B. Employing the same differential fluid channel 170 allows using a 3/2 pilot valve 400 for actuating D-SPA 100. 3/2 pilot valve 400 comprises a single actuator port 410 that can be brought in fluid communication with inlet port 171 of differential fluid channel 170. 3/2 pilot valve 400 can be shunted between a first, "pressurizing" position for introducing pressurized operating fluid via differential fluid channel 170 into chambers 120, 130A and 130B, and a second, "venting" position, allowing venting of the operating fluid from the chambers of D-SPA actuator 100 via differential fluid channel 170. In the first pressurizing position of 3/2 pilot valve 400, operating fluid is directed from a pilot valve inlet port 420 to the pilot valve actuator port 410 into differential fluid channel 170. In the second, venting position of 3/2 pilot valve 400, operating fluid is directed from differential fluid channel 170 through actuator port 410 to a valve outlet port 430.

In the discussion unless otherwise stated, adjectives such as "substantially" and "about" modifying a condition or relationship characteristic of a feature or features of an embodiment of the invention, are understood to mean that the condition or characteristic is defined to within tolerances that are acceptable for operation of the embodiment for an application for which it is intended.

In the description and claims of the present application, each of the verbs, "comprise" "include" and "have", and conjugates thereof, are used to indicate that the object or objects of the verb are not necessarily a complete listing of components, elements or parts of the subject or subjects of the verb.

Descriptions of embodiments of the invention in the present application are provided by way of example and are not intended to limit the scope of the invention. The described embodiments comprise different features, not all of which are required in all embodiments of the invention. Some embodiments utilize only some of the features or possible combinations of the features. Variations of embodiments of the invention that are described, and embodiments of the invention comprising different combinations of features noted in the described embodiments, will occur to persons of the art. The scope of the invention is limited only by the claims.

What is claimed is:

1. A spring-return actuator comprising:

a first piston housed in a first cylinder chamber, the piston movable from a first to a second position by pressurized fluid to move a load;

a safety system comprising a second piston moveable in a second cylinder chamber by the pressurized fluid to arm the safety system, the safety system configured to disarm to provide force to move the first piston from the second position toward the first position, when pressure of the pressurized fluid drops below a safety pressure threshold; and a differential fluid channel in cooperation with the first and second cylinder chambers and configured to provide pressurized fluid simultaneously to both the first and second chambers and provide pressurized fluid to the first chamber only to move the first piston towards the second position and provide pressurized fluid to the second chamber only to arm the safety system and provide flow of the pressurized fluid into the first cylinder chamber at a first flow rate while simultaneously providing flow of the pressurized fluid into the second cylinder chamber at a second flow rate, greater than the first flow rate so that the first piston while moving the load is disengaged from the safety system being armed by motion of the second piston;

wherein the differential fluid channel comprises a one-way contraction valve that causes contraction of the fluid channel providing pressurized fluid to the first piston.

2. The spring-return actuator according to claim 1, wherein the differential fluid channel comprises a single port that does not couple the differential fluid channel with either the first or second cylinder chamber and through which the pressurized fluid enters the differential fluid channel.

3. The spring-return actuator according to claim 1, wherein the differential fluid channel is formed in a wall of the spring-return actuator.

4. The spring-return actuator according to claim 1 wherein the first cylinder chamber and the second cylinder chambers are in tandem.

5. The spring-return actuator according to claim 4 wherein the second cylinder chamber comprises an elastic element that the second piston compresses when it arms the safety system.

6. The spring-return actuator according to claim 5 wherein the elastic element comprises a coil spring.

7. The spring-return actuator according to claim 5 wherein the elastic element provides the force to return the first piston to the first position when the safety system disarms.

8. The spring-return actuator according to claim 1 further comprising a component connected to the second piston that extends into the first cylinder chamber and applies the force to the first piston to push the first piston to return to the first position when the safety system disarms.

9. The spring-return actuator according to claim 1 further comprising a transmission that couples the first piston to the load to apply force to the load.

10. A system for driving a load, comprising:

a spring-return actuator according to claim 1; and a 3/2 pilot valve configured to provide pressurized fluid via the differential fluid channel.

11. A spring-return actuator comprising:

a first piston housed in a first cylinder chamber, the piston movable from a first to a second position by pressurized fluid to move a load;

a safety system comprising a second piston housed in a second cylinder chamber the second piston movable by the pressurized fluid to arm the safety system, wherein when pressure of the pressurized fluid drops below a safety pressure threshold the safety system disarms causing the second piston to move in the second cylinder and return the first piston from the second position to the first position; and a differential fluid channel in cooperation with the first and second cylinder chambers and configured to provide flow of the pressurized fluid into the first cylinder chamber at a first flow rate while simultaneously providing flow of the pressurized fluid into the second cylinder at a second flow rate, greater than the first flow rate so that the first piston while moving the load is disengaged from the safety system being armed by motion of the second piston wherein the differential fluid channel comprises a one-way contraction valve that causes contraction of the fluid channel providing pressurized fluid to the first piston.

* * * * *